United States Patent [19]

Stivers et al.

[11] 3,964,274

[45]* June 22, 1976

[54] NEEDLE FOOT SHOE FOR KNITTING NEEDLE

[75] Inventors: Edward C. Stivers, Atherton; Christopher L. Fischer, Sunnyvale, both of Calif.

[73] Assignee: Raychem Corporation, Menlo Park, Calif.

[ * ] Notice: The portion of the term of this patent subsequent to July 23, 1991 has been disclaimed.

[22] Filed: July 24, 1974

[21] Appl. No.: 491,327

Related U.S. Application Data

[63] Continuation of Ser. No. 221,906, Jan. 31, 1972, Pat. No. 3,842,626.

[52] U.S. Cl. ..... 66/123

[51] Int. Cl.[2] ..... D04B 35/04

[58] Field of Search ..... 66/123, 121; 75/175.5, 75/170; 148/11.5 R

[56] References Cited

UNITED STATES PATENTS

| | | | |
|---|---|---|---|
| 1,681,512 | 8/1928 | Beyer | 66/123 |
| 3,558,369 | 1/1971 | Wang et al. | 148/11.5 |
| 3,660,082 | 5/1972 | Negishi et al. | 75/170 |
| 3,699,784 | 10/1972 | Berentzen | 66/123 |
| 3,712,083 | 1/1973 | Slof et al. | 66/123 |
| 3,753,700 | 8/1973 | Harrison et al. | 75/175.5 |
| 3,807,992 | 4/1974 | Komatsu et al. | 75/170 |
| 3,842,626 | 10/1974 | Stivers et al. | 66/123 |

*Primary Examiner*—Mervin Stein
*Assistant Examiner*—A. M. Falik
*Attorney, Agent, or Firm*—Lyon & Lyon

[57] ABSTRACT

An improved needle for usein knitting machines is disclosed herein. The improved needle can operate at higher speeds than prior art needles without undue needle breakage. The needles are of the type which have a hook and latch at one end, a shaft extending from the hook and a needle foot protruding outwardly from the shaft. The foot is adapted to ride in a needle foot guide channel which causes the needle to move in an axial direction. The improved needle has a shoe convering at least a portion of the needle foot. The shoe is fabricated from a material which has a shear modulus of at least one million pounds per square inch and a loss tangent greater than 0.01, the shoe may be fabricated from a metal or a metal-elastomer composite.

9 Claims, 8 Drawing Figures

NEEDLE FOOT SHOE FOR KNITTING NEEDLE

This is a division of application Ser. No. 221,906, filed Jan. 31, 1972, now U.S. Pat. No. 3,842,626, issued Oct. 22, 1974.

BACKGROUND OF THE INVENTION

The field of the invention is knitting needles of the type used in knitting machines such as circular knitting machines. Such needles have a hook and hinged latch at one end. A shaft extends from the hook portion and a foot protrudes outwardly from the shaft. A plurality of such needles are used in a knitting machine and various needle holding and guide members are used to position and move the needles. The axial position of a needle is governed by the locating of the needle foot in a needle foot guide channel which may comprise a groove cut in the inner surface of a cylinder. As the cylinder rotates with respect to the needle holding member which holds the needles, a needle is caused to move axially in a predetermined manner by the camming action of the needle foot riding in the needle foot guide channel.

In an effort to improve the output of a knitting machine, higher operating speeds, resulting in an increase of the axial oscillation of the knitting needles has to be achieved. An increase in the axial oscillation velocity of the knitting needle and its associated increase in vibration stresses causes unacceptable breakage, especially in the hook portion of the needle.

Various methods have been utilized to help reduce needle breakage and, therefore, allow higher operating speed. One approach has been the addition of several bends in the needle shaft to cause a small amount of spring or give between the needle foot and the hook. Another approach comprises molding a plastic covering over the needle foot. Nylon 6, 6 has been used for this purpose and although this approach has permitted an increase in the axial velocity of the knitting needle, without the concomitant increase in destructive vibration, the life of such coverings is limited and thus the ability to increase the knitting speed has not been achieved.

SUMMARY OF THE INVENTION

It is an object of the present invention to provide an improved knitting needle which may be oscillated at higher speed without breakage.

It is another object of the present invention to increase the production from high speed knitting machines.

According to the present invention there is provided an improved needle having a shoe covering at least a portion of the needle foot of knitting machine needles. The material from which the shoe is fabricated should have both a relatively high modulus (shear modulus greater than $10^6$ pounds per square inch) and relatively good damping characteristics (loss tangent greater than 0.01). In nature most materials which have a high modulus also have poor damping characteristics and materials which have good damping characteristics tend to have a low modulus. Particular materials are disclosed herein, however, which achieve this unusual combination of attributes. The shoe may either be a metal having excellent damping characteristics or a metal-polymer laminate or composite. Examples of metals having excellent damping characteristics are certain alloys of titanium and nickel and certain alloys of copper including copper-manganese alloys; particularly appropriate alloys are discussed below.

When the shoe is a metal-polymer composite, it is not essential that the metal itself have excellent damping characteristics. For instance, the metal could be hardened steel and the polymer could be nylon 6, 6 or a polyurethane. Further details regarding these metal-polymer composites are given below.

DESCRIPTION OF THE PREFERRED EMBODIMENTS

Figure 1:
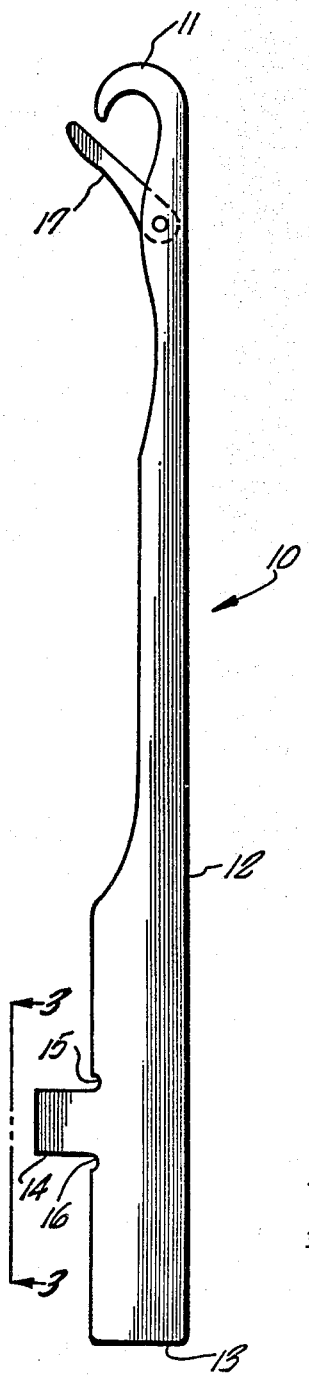
FIG. 1 is a side elevation of a knitting needle of the type used in knitting machines.

A knitting needle of the type used in knitting machines is shown in FIG. 1 and identified by reference character 10. The needle 10 has a hook 11 at one end and has a longitudinal shaft 12 which extends from a hook area down to the base 13. A foot 14 protrudes from one side of shaft 12 and longitudinal movement of the needle is brought about by forces exerted on foot 14 in a manner described below. Stress relief notches 15 and 16 are formed in the shaft adjacent foot 14.

Near the hook end of the needle 10 is a pivotally mounted latch 17 which opens when the needle moves upwardly through woven material and closes when the needle moves downwardly. Needles with such latches are known to those skilled in this art and a description of the details of their operation is not necessary for an understanding of the present invention.

Figure 2:
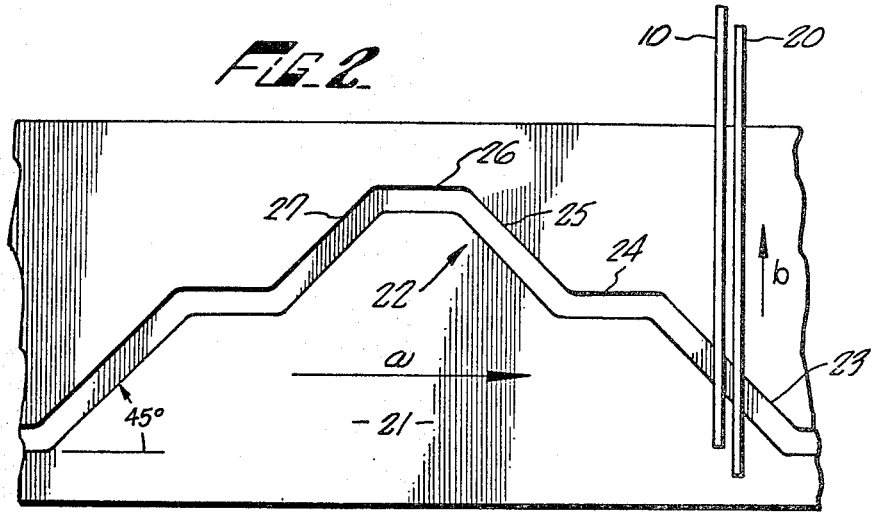
FIG. 2 is a side elevation of a needle foot guide having two needles positioned adjacent thereto.

A guide which regulates the movement of the needles may be seen in FIG. 2 which illustrates needles 10 and 20 positioned between side walls in the needle groove 22 of needle guide 21. The needles are commonly held in place by a cooperating series of grooves (not shown) located in a needle holding member which travels with respect to needle guide 21. These grooves position the needles in a constant spacing but permit the needles to move in a longitudinal direction. The needle guide 21 is then moved with respect to the needles in the direction of arrow "*a*". A needle foot, such as that identified by reference character 14 in FIG. 1, rides in needle groove 22 and the movement of needle guide 21 with respect to the needle can result in longitudinal movement of the needle. For instance, when guide 21 is moved in the direction of arrow *a*, needle 10 will move upwardly in the direction of arrow "*b*" as long as the needle foot is riding in the inclined portion 23 of needle groove 22. When the needle foot reaches the horizontal portion 24 of needle groove 22, the vertical position of the needle will remain constant until the needle foot reaches inclined portion 25 of groove 22. Similarly, the needle will remain in a constant vertical position when the needle foot is riding in horizontal portion 26 of groove 22 and will move downwardly when the foot is in section 27 of groove 22. The inclined portions of groove 22 may be at various angles with respect to the horizontal other than that shown in the drawing at 45°.

As can be seen, the desired increase in the movement of the needle results from a faster relative surface speed between the needle foot guide 21 and the needle. It has been found that the needles begin to break in the hook area if the needle movement becomes too rapid. The present invention is directed toward solving this breaking problem.

Figure 3:
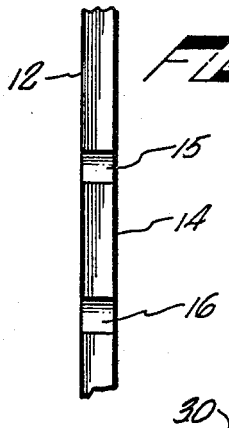
FIG. 3 is an enlarged view taken along line 3—3 of FIG. 1 showing the needle foot.

The needle foot 14 of needle 10 is shown in end view in FIG. 3. Stress relief notches 15 and 16 are used to decrease the stress and thus reduce breakage of the needle at the point between the needle foot and the needle shaft.

Figure 4:
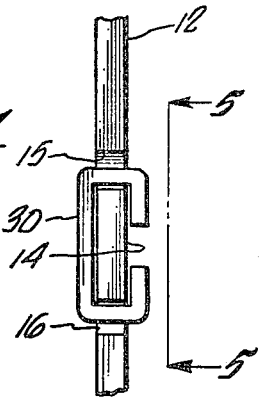
FIG. 4 is a front elevation of the needle foot of FIG. 3 partially surrounded by a shoe.
Figure 5:
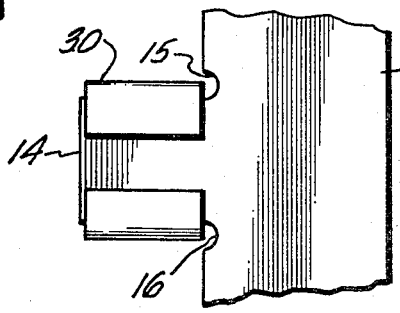
FIG. 5 is a view taken along line 5—5 of FIG. 4.

The tendency toward needle breakage can be significantly reduced by the provision of a shoe located in contact with the needle foot guide. One such shoe is shown in FIGS. 4 and 5 where a C-shaped shoe 30 is shown partially surrounding needle foot 14. Shoe 30 is composed of a metal having the desired combination of a shear modulus greater than $10^6$ pounds per square inch and a loss tangent greater than 0.01.

The shear modulus is, of course, the ratio of the shearing stress to the corresponding shearing strain. It is expressed in force per unit area and in the present application specifically in pounds per square inch. The shear modulus can be determined for laminated materials and a laminate made from one layer of a metal and a layer of a typical polymer of equivalent thickness will have a shear modulus approximately one-half that of the metal used. That is, the strength of the laminate will depend almost entirely on the metal layer.

The ability of a material to perform a damping function is commonly expressed by the loss tangent. The loss tangent is expressed by the following formula:

$$\text{Loss Tangent} = \frac{1}{\pi} \cdot \ln \frac{A_n}{A_{(n-1)}}$$

where:

$A_n$ = Amplitude of $n^{th}$ wave $A_{(n-1)}$ = Amplitude of $n^{th} - 1$ wave

The above amplitudes are determined at low frequency by the use of a torsional pendulum. Like shear modulus, the loss tangent of laminated materials can be determined by testing a sample of the laminate. The loss tangent of a laminate comprising an elastic layer and a viscous layer will, of course, be determined largely by the nature of the viscous material.

While the damping characteristics of nylon 6, 6 are satisfactory (loss tangent = 0.026) its shear modulus is below $10^6$ psi ($0.14 \times 10^6$ psi). Conversely, while steel of the type used in many needles has a sufficient shear modulus ($8.7 \times 10^6$ psi) its damping characteristics are not satisfactory (loss tangent = 0.0019).

Shoe 30 should also have excellent wear characteristics so that it will not be abraded by contact with the needle foot guide. Metals having the requisite shear modulus and loss tangent levels together with acceptable wear characteristics include many alloys which also exhibit the characteristic of "memory", that is, a return to an original configuration with temperature change.

A particularly effective composition comprises alloys having as major ingredients the metals titanium and nickel. Many alloys have major proportions of titanium and nickel are known to possess the ability to transform from a martensitic crystal structure having excellent damping characteristics to an austenitic structure upon warming. Excellent damping characteristics are possessed by such alloys when in their martensitic state. Thus, the present invention includes the use of alloys having major proportions of titanium and nickel which alloys exist in the martensitic state at the operating temperature of the metallic member. Means for establishing a desired transformation temperature are known and include varying the percentage of titanium and nickel. Furthermore, the transformation temperature may be adjusted by the addition of small amounts of other metals such as cobalt, iron, aluminum and manganese. A more complete disclosure of the nature of such alloys may be found in an application filed July 2, 1970, by John D. Harrison, et al., Ser. No. 51,809, now abandoned and an application filed on the same day by Harrison, et al., Ser. No. 52,112, now U.S. Pat. No. 3,753,700, issued Aug. 21, 1973. Both the application and the patent are assigned to the assignee of the present invention. The disclosures of these two applications are incorporated by reference herein for purposes of background information. A typical alloy useful in the practice of the present invention contains the following metals expressed in atomic percent: 50% Ti, 50% Ni. Such an alloy has a loss tangent of 0.036, and a shear modulus of $2.87 \times 10^6$ pounds per square inch.

Figure 6:
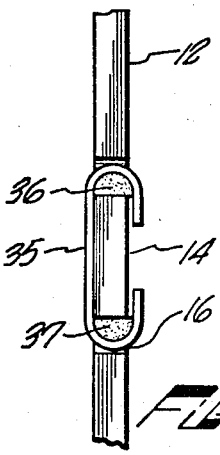
FIG. 6 is a front elevation of a needle foot and shoe.

In general, metals to which the property of heat recoverability may be imparted have good damping characteristics when such metals are in their low temperature state. Beta copper alloys are useful in conjunction with the present invention. A shoe useful in the practice of the present invention can alternatively be achieved by the use of a metal-polymer composite. One such composite is shown in FIG. 6 where a C-shaped shoe is shown partially surrounding needle foot 14. The shoe comprises a metallic member 35 and quantities of polymer 36 and 37 are located between the upper and lower faces of needle foot 14 and the inner surface of metallic member 35. By the use of such configurations, the metallic member 35 need not be fabricated from a metal having good damping characteristics. Its wearing and friction characteristics may then be a major consideration. Polymer 36 should possess excellent damping characteristics and suitable polymers include polyurethane elastomers, nylon, such as nylon 6, 6, polytetrafluoroethylene copolymer elastomers, a polyamide whose repeating units comprise a tetravalent organic moiety and the residue of either 1, 12 diamino dodecamethylene or 1, 13 diamino tridecamethylene. The polymer should maintain its structural integrity at the operating temperatures of the shoe.

The metallic member 35 of such composites may be hardened steel, titanium-nickel alloys having an austenitic crystal structure, or other metal having relatively-high strength and wear characteristics. Stainless steel alloys may also be used.

Figure 7:
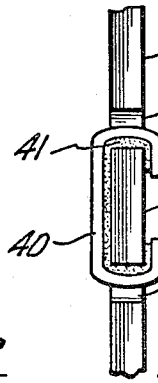
FIG. 7 is a front elevation of a needle foot and shoe.

A different location of polymer of a composite shoe is shown in FIG. 7 where metallic member 40 is separated from foot 14 by a C-shaped layer of polymer 41. This location of polymer prevents any rubbing contact between member 40 and foot 14 and tends to increase the damping characteristics of the composite.

Figure 8:
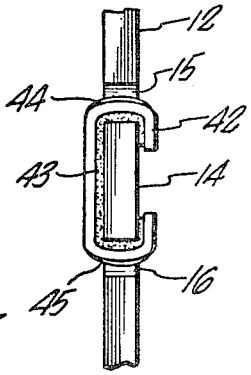
FIG. 8 is a front elevation of a needle foot and shoe.

The composite shoe shown in FIG. 8 is similar to that shown in FIG. 7 where metallic member 42 is separated from foot 14 by a C-shaped layer of polymer 43. The upper and lower surfaces 44 and 45 of member 42 are coated with a hardened composition such as tungsten carbide in order to improve the wearing characteristics of member 42. The tungsten carbide may be flame plated when the metallic member is not readily plated by other means. Member 42 may be fabricated from metals like those described useful for the fabrication of member 35. Friction-reducing agents or coatings such as molybdenum disulfide may be used on the outer surface of the metallic members to further reduce wear.

It is believed that the metal-polymer shoe is capable of providing protection from breakage as a result of the ability of this composite to dissipate mechanical energy in the form of heat. Heat is generated by the physical distortion of a layer of viscoelastic material sandwiched between the vibrating structure and a thin metal constraining layer. While not bound by any theory, it is believed that needle breakage results from resonant vibration which is reduced or prevented by the presence of the metal-polymer composite.

Similarly, when the shoe is fabricated from a metal having excellent damping characteristics, it is believed that this same elimination or reduction of resonant vibration results. Thus, when the needle foot reaches the intersection between a horizontal and an inclined portion of the needle foot groove, a certain amount of energy or shock is believed to be absorbed by the metal-surfaced damping shoe and thus is not transmitted through the needle shaft to the needle hook. Thus, the particular choice of material for construction of the shoe is related to the needle size and oscillation frequency and it is not possible to describe a shoe composition which will be optimum under all conditions.

Although the shoes shown in the drawings are C-shaped, other shapes may also be used. For instance, the shoe can be in the shape of an elongated O. Alternatively, the shoe could merely surround the top and bottom surfaces of the needle foot and thus be in the shape of two U's. It is preferable that the outer surface of the composition be rounded in order to reduce wear both upon the composite itself and on the needle foot guide. Various coatings may be placed on the outer surface of the shoes in order to reduce corrosion, friction or wear. Such coatings are known to those skilled in the art and will not be described here in detail. One example is a chromium plating known by the trade name "Electrolized".

The polymer may be applied to the needle foot in any conventional manner such as the insertion of a premolded member over the needle foot prior to the placement of the metallic member. Alternatively, the polymer may be molded directly over the needle foot and a hole or plurality of openings or indentations may be provided in the needle foot to hold the polymer in place. Still further, the needle foot may be dipped in a liquid plastic which may then be cured or dried to form the polymeric member. Still further, the metal and polymer may be laminated or adhered to one another prior to placement over the needle foot. Also, the polymer could be provided in the form of a heat-shrinkable tube which could be placed over the needle foot and shrunk in place prior to the placing of the metallic member around the polymer. It is advantageous to provide a tight fit between the needle foot and the polymer in order to reduce the amount of impact exerted on the polymer by the needle foot.

The needle foot should, of course, be modified in exterior dimensions to permit the shoe to be placed over it without causing a binding of the shoe in the needle groove. The separation between the outer surface of the shoe and the needle groove should not be so great, however, as to cause an impact or slap between the shoe and the groove. Since wear can increase this tolerance a high wear surface such as tungsten-carbide is advantageous.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

We claim:

1. A knitting machine needle of the type which has a hook at one end and a shaft extending from the hook and a needle foot extending outwardly from said shaft and adapted to ride in a needle foot guide channel having side walls wherein the improvement comprises shoe means positioned over at least that portion of said foot which contacts the side walls of said needle foot guide channel, said shoe means having a shear modulus of at least 1,000,000 pounds per square inch and a loss tangent of at least 0.01.

2. The needle of claim 1 wherein said shoe means is a metal.

3. The needle of claim 2 wherein said metal is an alloy containing major proportions of titanium and nickel having a transition temperature above the operating temperature of said needle foot whereby said alloy remains in a martensitic state.

4. The needle of claim 2 wherein said metal is capable of having the property of heat recoverability imparted thereto and said metal is in its low temperature state.

5. The needle of claim 10, wherein said metal is a beta copper alloy.

6. The needle of claim 2, wherein said metal has a hardened outer surface.

7. The needle of claim 5, wherein said hardened surface comprises a coating of chromium.

8. The needle of claim 2, wherein said metal has a coating of tungsten-carbide on at least a portion of its outer surface.

9. The needle of claim 2, wherein said metal is a copper-manganese alloy.

* * * * *

UNITED STATES PATENT AND TRADEMARK OFFICE

CERTIFICATE OF CORRECTION

PATENT NO. : 3,964,274

DATED : June 22, 1976

INVENTOR(S) : EDWARD C. STIVERS & CHRISTOPHER L. FISCHER

It is certified that error appears in the above-identified patent and that said Letters Patent are hereby corrected as shown below:

In column 6, line 47, correct the dependency of claims by deleting "10" and inserting therefor -- 4 --.

In column 6, line 51, correct the dependency of claim 7 by deleting "5" and inserting therefor -- 6 --.

Signed and Sealed this

Fifth Day of October 1976

[SEAL]

*Attest:*

RUTH C. MASON
*Attesting Officer*

C. MARSHALL DANN
*Commissioner of Patents and Trademarks*